US012686048B2

(12) United States Patent
Mokre et al.

(10) Patent No.: US 12,686,048 B2
(45) Date of Patent: Jul. 21, 2026

(54) APPARATUS AND PROCESS FOR CASTING METAL PARTS

(71) Applicant: Nemak, S.A.B. de C.V., García (MX)

(72) Inventors: Alexander Mokre, Linz (AT); Zsolt Molnar, Györ (HU)

(73) Assignee: Nemak, S.A.B. de C.V., García (MX)

( * ) Notice: Subject to any disclaimer, the term of this patent is extended or adjusted under 35 U.S.C. 154(b) by 0 days.

(21) Appl. No.: 19/121,350

(22) PCT Filed: Oct. 5, 2023

(86) PCT No.: PCT/IB2023/059997
§ 371 (c)(1),
(2) Date: Apr. 15, 2025

(87) PCT Pub. No.: WO2024/084321
PCT Pub. Date: Apr. 25, 2024

(65) Prior Publication Data

US 2026/0108934 A1 Apr. 23, 2026

(30) Foreign Application Priority Data

Oct. 17, 2022 (EP) ..... 22201918

(51) Int. Cl.
*B22C 9/08* (2006.01)
*B22D 18/04* (2006.01)

(52) U.S. Cl.
CPC ..... *B22C 9/088* (2013.01); *B22D 18/04* (2013.01)

(58) Field of Classification Search
CPC ..... B22C 9/088; B22D 18/04
See application file for complete search history.

(56) References Cited

U.S. PATENT DOCUMENTS 4,928,746 A 5/1990 Butler et al.
4,961,460 A * 10/1990 Butler ..... B22C 9/086 164/358

(Continued)

FOREIGN PATENT DOCUMENTS

CN 104550747 A 4/2015
CN 105880477 A 8/2016

(Continued)

OTHER PUBLICATIONS

European Search Report for 22201918.4; Mar. 29, 2023.
PCT International Search Report for PCT/IB2023/059997; Nov. 28, 2023.

*Primary Examiner* — Keith Walker
*Assistant Examiner* — Steven S Ha
(74) *Attorney, Agent, or Firm* — Stetina Garred Brucker & Newboles

(57) ABSTRACT

An improved apparatus for casting metal parts. The apparatus is contemplated as including at least one mold cavity formed by at least one at least partly surrounding cavity wall, a system of sprues, runners and/or ingates defining at least one flow channel for filling the at least one mold cavity with molten metal, at least one riser insert arranged at least partly inside at least one riser cavity of at least one riser. The at least one riser insert comprises at least one insert cavity for receiving molten metal at least partially from the at least one mold cavity and at least one the insert cavity at least partly surrounding riser insert wall, wherein the at least one riser insert is configured to at least partly decelerate the solidification of the molten metal received by the at least one insert cavity.

14 Claims, 1 Drawing Sheet

(56) References Cited

U.S. PATENT DOCUMENTS

| | | | | | |
|---|---|---|---|---|---|
| 5,896,912 | A * | 4/1999 | Monroe | ..... | B22D 15/005<br>164/358 |
| 6,841,120 | B2 * | 1/2005 | Grassi | ..... | F27D 3/14<br>266/239 |

FOREIGN PATENT DOCUMENTS

| | | | | | |
|---|---|---|---|---|---|
| CN | 105903904 | A | | 8/2016 | |
| CN | 208341648 | U | | 1/2019 | |
| CN | 111545725 | A | * | 8/2020 | ..... B22D 18/04 |
| CN | 216966209 | U | | 7/2022 | |
| JP | 58084666 | A | * | 5/1983 | |

* cited by examiner

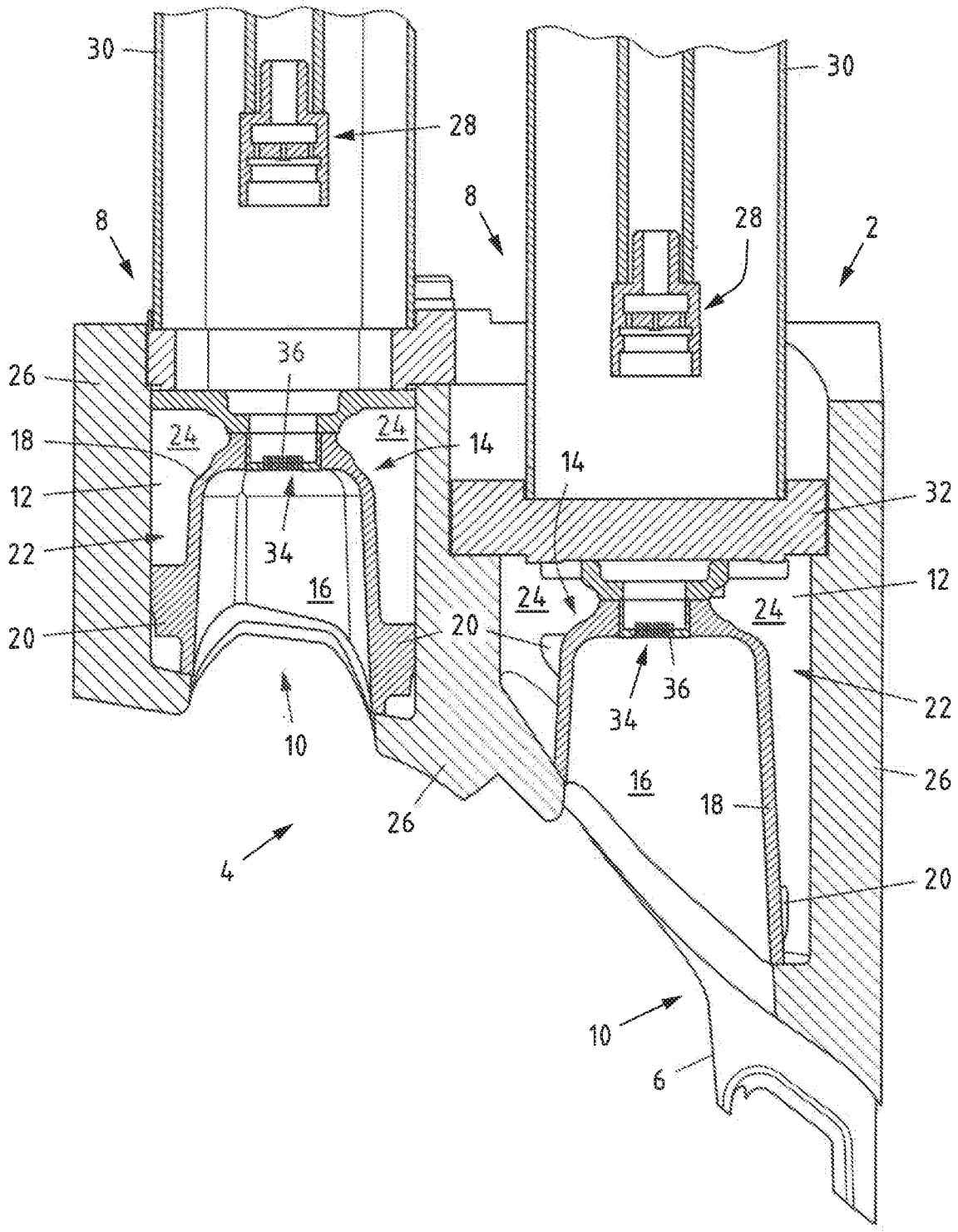
30
28
8
36
26
18
24
14
12
22
34
16
20
10
4
26
30
8
28
2
14
32
12
24
24
20
36
34
22
16
18
26
20
10
6

APPARATUS AND PROCESS FOR CASTING METAL PARTS

CROSS-REFERENCE TO RELATED APPLICATIONS

This application claims priority to PCT International Application No. PCT/IB2023/059997 filed on Oct. 5, 2023, which claims priority to European Patent Application No. 22201918.4 filed on Oct. 17, 2022, the entire disclosures of which are expressly incorporated herein by reference.

STATEMENT RE: FEDERALLY SPONSORED RESEARCH/DEVELOPMENT

Not Applicable

BACKGROUND

Technical Field

The present invention relates to an apparatus for casting, in particular low pressure die casting, metal parts, in particular aluminum parts, comprising: at least one mold cavity formed by at least one at least partly surrounding cavity wall, and a system of sprues, runners and/or ingates defining at least one flow channel for filling the at least one mold cavity with molten metal. The invention also relates to a process for casting, in particular for low pressure die casting, metal parts, in particular aluminum parts, in a mold, wherein the process for casting is in particular performed by an aforementioned apparatus.

Description of the Related Art

It is known in the casting industry that filling a mold cavity with molten metal to form a good quality cast metal part requires precision in performing all the sequenced stages of the casting process so that the molten metal solidifies properly and produces cast parts with the desired mechanical properties and substantially without surface defects, inclusions of other materials and gases, as well as geometric dimensional integrity.

A number of factors affect the quality of cast parts. For example, regarding cast parts of complex geometry and thin-walled forms, the molten metal must be overheated for obtaining good fluidity which ensures that the mold cavity is fully filled up. However, the higher the temperature of the molten metal, the longer it takes for cooling and solidifying the cast part.

It is a widely-spread practice in the casting industry to fill the molds from the bottom up with the liquid metal. The purpose of this measure is to ensure that the molten metal flows in a non-turbulent and quiescent flow into the mold so that it does not entrap any air or other gases which may form voids in the cast part.

To this end, in common practice a system of sprues, runners and ingates is provided which allows to pour the molten metal being provided in a ladle into the channel system of the mold so that it fills the mold cavity in which the respective cast part is formed and enters into a riser being arranged above the top level of the cast part. The liquid metal being present in the riser may provide an amount of metal needed to fill a gap or a void that might form due to a volume contraction involved in the solidification of the molten metal.

Unfortunately, commonly used risers may not provide their thermal center during solidification of the molten metal in the middle of the riser, but rather closely above the casting surface. This may lead to shrinkages during the solidification of the molten metal in the riser neck which may also be visible in the cast metal part after the riser has been removed.

Also, due to the thermal design of commonly used risers, an extra amount of molten metal is regularly used during the cast process since it has to be guaranteed that the molten metal in the riser substantially solidifies after the molten metal in the mold cavity and enough molten metal is present during the cast process in the riser.

In order to improve the thermal characteristics of commonly used risers, it is known to enhance the isolation characteristics of the risers by applying a brush coating. However, said coatings usually do not have a long lifetime which may result in downtimes of the casting apparatus due to a repair of the coating. Further, the application temperature of the coating may be lower than the working temperature of the cast process which may hinder an efficient appliance of the coating.

Therefore, the present invention is faced with the problem of suggesting an apparatus and a process for casting metal parts which sufficiently enhances the mechanical properties of the cast part and also reduces the amount of material required.

BRIEF SUMMARY

According to a first aspect of the present invention there is disclosed an apparatus for casting, in particular low pressure die casting, metal parts, in particular aluminum parts, comprising: at least one mold cavity formed by at least one at least partly surrounding cavity wall, a system of sprues, runners and/or ingates defining at least one flow channel for filling the at least one mold cavity with molten metal, at least one riser insert for being arranged at least partly inside at least one riser cavity of at least one riser, wherein the at least one riser insert comprises at least one (riser) insert cavity for receiving molten metal at least partially from the at least one mold cavity and at least one the insert cavity at least partly surrounding riser insert wall, wherein the at least one riser insert is configured to at least partly decelerate the solidification of the molten metal received by the at least one insert cavity.

According to a second aspect of the invention there is disclosed a process for casting, in particular for low pressure die casting, metal parts, in particular aluminum parts, in a mold, wherein the process for casting is in particular performed by an aforementioned apparatus, comprising: forming at least one mold cavity by at least one at least partly surrounding cavity wall, filling the at least one mold cavity with molten metal via at least one flow channel being defined by a system of sprues, runners and/or ingates, arranging at least one riser insert least partly inside at least one riser cavity of at least one riser, wherein the at least one riser insert comprises at least one (riser) insert cavity for receiving molten metal at least partially from the at least one mold cavity and at least one the insert cavity at least partly surrounding riser insert wall, decelerating the solidification of the molten metal received by the at least one insert cavity at least partly during the casting process.

By providing at least one riser insert, the cast process and/or the apparatus may be adjusted in a constructively convenient way with regard to the metal part to be cast. Through at least partly decelerating the solidification of the molten metal received by the at least one insert cavity of the at least one riser insert, the feeding effectivity, the process stability and/or the reliability of the casting process may be improved. In particular, less material may be used while still being able to provide a cast metal part with sufficient mechanical properties by reducing surface defects of inclusions of other materials or gases.

The casting process used may in particular be pressure casting or low pressure die casting (LPDC). Accordingly, the apparatus may be a low pressure die casting apparatus or a part thereof and the casting mold used may be a die-cast suitable for low pressure die casting. In particular, the at least one cavity mold may be filled from the bottom up with the liquid metal. This allows for the molten metal flows to flow in a non-turbulent and quiescent way into the mold so that it an entrapment of air or other gases which may form voids in the cast part may be reduced or substantially prevented.

Accordingly, the term metal part is understood to cover the state from molten metal to completely solidified metal in the casting mold. Preferably, the metal may be aluminum or an aluminum alloy.

The process may in particular be performed by an apparatus according to the invention.

In particular, the at least one riser insert is configured in such a way that the temperature of the molten metal received by the at least one insert cavity is substantially higher than the temperature of the molten metal in the at least one mold cavity. The temperature of the molten metal received by the at least one insert cavity preferably is the average temperature of the molten metal in the at least one insert cavity. The temperature of the molten metal in the at least one mold cavity preferably is the average temperature of the molten metal in the at least one mold cavity. In particular, the riser insert is configured in such a way that the molten metal received by the at least one riser insert cavity substantially solidifies after the molten metal in the at least one mold cavity. Hereby, it may be ensured that the riser and/or the riser insert comprises molten metal which may flow into the mold cavity for preventing shrinkages during solidification in the cast metal part.

According to an exemplary aspect of all aspects of the invention, the at least one riser insert wall comprises a thickness of less than 5 cm, in particular less than 3 cm, preferably less than 1.5 cm. By providing a relatively thin walled riser insert wall, the riser insert wall may be heated up quickly, in particular quicker than the at least one cavity wall of the mold cavity, so that only a small amount of the heat of the molten metal arranged in the at least one riser insert cavity is transferred for heating up the at least one riser insert wall. This may allow for a deceleration of the solidification of the molten metal received by the at least one insert cavity in a convenient way. The thickness of the at least one riser insert wall may vary along the extension of the at least one riser insert wall. The thickness of the at least one riser insert wall may be the thickness of a thinnest area of the at least one riser insert wall or the thickness of a thickest area of the at least one riser insert wall. Preferably, the thickness of the at least one riser insert wall is the average thickness of the at least one riser insert wall, in particular if the thickness of the at least one riser insert wall varies along its extension.

According to an exemplary aspect of all aspects of the invention, the at least one riser comprises at least one insulating means for insulating the molten metal received by the at least one insert cavity. By providing at least one insulation means, the heat transfer from the molten metal arranged inside the at least one riser cavity may further be reduced, so that the solidification of the metal arranged inside the at least one riser cavity may be decelerated. This may for example enable the usage of less molten metal during the cast process and also allows for liquid metal flowing into the mold cavity from the riser insert cavity during the cast process.

According to another exemplary aspect of all aspects of the invention, the at least one insulating means comprises at least one air gap arranged between the riser insert wall of the riser insert and a riser wall of the at least one riser. This may allow for a cost-effective insulation of the molten metal arranged in the at least one riser insert cavity and thus enable a deceleration of the molten metal inside the at least one riser cavity. Preferably, the at least one air gap may substantially surround, preferably substantially circularly surround or encompass, the at least one riser insert.

According to an exemplary aspect of all aspects of the invention, the at least one insulation means comprises wool material, in particular rock wool, stone wool, glass wool and/or a combination thereof, and/or ceramic insulating material. This may allow for at least partly preventing convection and radiation of the heat of the molten metal arranged inside the at least one riser insert cavity and thus enable an efficient deceleration of the solidification of the molten metal arranged inside the at least one riser insert cavity, in particular in comparison to the solidification of the molten metal inside the mold cavity. Preferably, the wool material may at least partly surround the at least one riser insert. Preferably, the wool material is arranged at least party in the at least one air gap arranged between the riser insert wall of the riser insert and the riser wall of the at least one riser. The at least one insulating means may further comprise ceramic insulating material, wherein, preferably, the at least one riser insert wall comprises or is made of the ceramic insulating material. Such ceramic materials may be beneficial regarding the heat radiation of the at least one riser insert.

According to an exemplary aspect of all aspects of the invention, at least one heating insert for at least partly heating the molten metal received by the at least one insert cavity is provided, and the at least one heating insert is preferably arranged at least partly inside the at least one riser cavity and/or at least partly inside at least one protection element. Through the usage of at least one heating insert, heat may be introduced externally to the molten metal arranged inside the at least one riser cavity. In particularly, it may be ensured that the molten metal arranged inside the at least one riser insert cavity comprises a higher temperature than the molten metal arranged inside the at least one mold cavity. Thus, it may be ensured in a constructively beneficial manner that the metal in the at least one riser insert cavity substantially solidifies after the metal arranged in the mold cavity. This allows for beneficial mechanical properties of the cast metal part. The at least one heating insert is preferably arranged closely to and/or at least partly inside the at least one riser cavity in order to sufficiently heat the (molten) metal arranged inside the at least one riser insert cavity. Preferably, the at least one heating insert is arranged at least partly inside at least one protection element, in particular at least partly inside a protection pipe, in order to allow a sufficient heat radiation into the direction of the at least one riser insert cavity.

According to an exemplary aspect of all aspects of the invention, the at least one heating insert is configured as at least one burner and/or as at least one electric heating cartridge. This allows for an efficient heating of the metal arranged inside the at least one riser insert cavity. The at least one heating insert may also be configured as an inductive heating element. Hereby not only the material, in particular the steel material, of the at least one riser insert, may be efficiently heated, but also the molten metal, in particular the molten aluminum arranged in the at least one riser insert, may be directly heated.

According to an exemplary aspect of all aspects of the invention, the apparatus further comprises at least one sensor means for monitoring the at least one heating insert, in particular for measuring the heat radiation of the at least one heating insert. The at least one sensor means may for example be at least one thermocouple. Hereby it may be ensured that the at least one heating insert is radiating a sufficient amount of heat for enabling the metal in the at least one riser insert cavity to substantially solidify after the metal arranged in the mold cavity. The at least one sensor means may be in particular arranged in the proximity of the at least one riser insert. Preferably, the at least one sensor means is fixated to and/or inserted in the center and/or centering means of the at least one heating insert.

According to an exemplary aspect of all aspects of the invention, at least one holding element is at least partly arranged between the at least one riser insert and the at least one heating insert, and the at least one holding element is preferably at least partly arranged inside the riser cavity. Preferably, the at least one holding element is heated via the at least one heating insert so that the holding insert transfers the heat to the at least one riser insert cavity and the (molten) metal arranged in the at least one riser insert cavity. This allows for a reliable and uniform heat transfer of the heat generated by the at least one heating insert. Alternatively, the at least one riser and/or the at least one riser insert may be directly heated by the at least one heating insert, which may provide an energy efficient heating of the (molten) metal arranged inside the at least one riser insert cavity.

According to an exemplary aspect of all aspects of the invention, the at least one riser insert comprises centering means, in particular centering pins, for aligning and/or fixating the at least one riser insert inside the at least one riser cavity. This allows for an efficient alignment and/or a reliable fixation of the at least one riser insert. Preferably, the centering means are formed integrally with the at least one riser insert, wherein the centering means preferably extend towards an outward direction of the at least one riser insert. Preferably, the extension of the centering means does not contribute to the thickness of the at least one riser wall insert.

According to an exemplary aspect of all aspects of the invention, the at least one riser insert comprises at least one venting hole for ventilating the metal received by the at least one insert cavity. In particular during low pressure die casting, a reliable venting is needed in order to ensure a qualitatively sufficient cast metal part. Preferably, the at least one venting hole is arranged at the substantially distal end of the at least one riser insert with regard to the end of the riser insert corresponding to the at least one mold cavity. The at least one venting hole may comprise a substantially circular cross-section. A venting insert may be arranged inside the at least one venting hole, wherein the venting insert may comprise a plurality of venting slits.

According to an exemplary aspect of all aspects of the invention, the at least one riser insert is in fluid connection with at least one riser neck of the at least one riser for receiving molten metal at least partially from the at least one mold cavity.

The present invention in particular is suited for casting cast parts for combustions engines, such as blocks and cylinder heads from light metal alloys, especially aluminum alloys. The present invention may also be suited for casting cast parts for structural components, for electrical motors and the like.

The exemplary embodiments described in this description are also intended to be disclosed with respect to every aspect and in all combinations with one another. In particular, a method or process step is intended to also disclose respective means for performing the method or process step. Likewise, means for performing a certain method or process step are also intended to disclose the respective method or process step.

Further advantageous exemplary embodiments of the invention are indicated by the following detailed description of a number of practical examples of the present invention, in particular in connection with the FIGURE.

BRIEF DESCRIPTION OF THE DRAWINGS

The FIGURE attached to the application, however, is only intended to be used for the purpose of clarification, and not to determine the scope of protection of the invention. The attached drawing is intended only as an example reflecting the general concept of the present invention. In particular, features shown in the FIGURE should not in any way be considered an essential component part of the invention.

In the following, the invention will be described in more detail with reference to the FIGURE.

FIG. 1 shows a schematic detail view of an exemplary embodiment of an apparatus for casting metal parts in a cross-sectional perspective.

DETAILED DESCRIPTION

FIG. 1 discloses a schematic detail view of a first embodiment of an apparatus 2 for casting metal parts in a cross-sectional perspective. The apparatus 2 comprises one mold cavity 4 which is formed by a cavity wall 6. Only a part of the mold cavity 4 is shown in FIG. 1. Additionally, the apparatus 2 comprises two risers 8, wherein the risers 8 are in fluid connection with the mold cavity 4 via respective riser necks 10.

Inside riser cavities 12 of the two risers 8 riser inserts 14 are arranged respectively, wherein the riser inserts 14 each form a (riser) insert cavity 16 for receiving molten metal arranged from the mold cavity 4 and/or supplying the mold cavity 4 with molten metal. The riser insert cavities 16 are surrounded by riser insert walls 18. The riser insert walls 18 preferably comprise a thickness of less than 3 cm, preferably of less than 1.5 cm, wherein centering pins 20 integrally formed with the riser insert walls 18 do not constitute to the thickness of the riser insert walls 18. Hence, the riser walls 18 without the lateral extension of the centering pins 20 comprise a thickness of less than 3 cm, preferably of less than 1.5 cm. Through the centering pins 20, the riser inserts 14 are aligned and fixated inside the riser cavities 12. Sensor means (not shown) for monitoring the heating inserts 28 may be fixated to the centering pins 20.

Between the risers 8 and the riser insert 14 insulating means 22 are arranged for insulating the molten metal received by the riser insert cavities 16. The insulating means 22 are formed as air gaps 24 which circularly surround the riser inserts 14 and are arranged between the riser insert walls 18 and riser walls 26 of the risers 8.

Further, heating inserts 28 are arranged inside protection elements 30 for distributing heat towards the riser insert cavities 16 during a casting process. Hereby, the solidification of the molten metal inside the riser insert cavities may be decelerated and thus a sufficient flow of molten metal from the riser insert cavities 16 to the mold cavity 4 may be provided.

Holding elements 32 and 33, in particular holding plates 32 and holding rings 33 are arranged between the riser inserts 14 and the heating inserts 28. The holding plates 32 and holding rings 33 comprise an opening so that the heat radiated by the heating inserts 28 may be directly radiated to the riser inserts 14. The holding elements 32 and 33 are arranged inside the riser cavity 12.

The riser inserts 14 comprise a venting hole 34 respectively for ventilating the metal received by the at least one riser insert cavity 16, wherein the venting hole 34 is arranged at the distal end with regard to the riser neck 10. Inside the venting hole 34 a venting insert 36 comprising a plurality of venting slits is arranged.

The riser inserts 14 are in fluid connection with the riser necks 10 of the risers 8 for receiving molten metal at least partially from the at least one mold cavity 4.

The exemplary embodiments/aspects of the present invention described in this specification are intended to be understood as disclosed both individually and in all combinations with each other. In particular, even the description of a feature encompassed by an embodiment—unless explicitly stated to the contrary—is not intended to be understood herein as implying that the feature is indispensable or essential to the function of the embodiment. The sequence of the process steps described in this specification is not mandatory; alternative sequences of the process steps are conceivable. The process steps can be implemented in various ways, for example, implementation in software (by program instructions), hardware or a combination of both is conceivable for implementing the process steps.

Terms used in the patent claims such as "comprising", "having", "including", "containing" and the like do not exclude further elements or steps. The wording "at least in part" or "substantially" covers both the case "in part" and the case "in full". The phrase "and/or" is intended to be understood to disclose both the alternative and the combination, thus "A and/or B" means "(A) or (B) or (A and B)". A plurality of entities, persons or the like means multiple entities, persons or the like in the context of this specification. The use of the indefinite article does not preclude a plural. A single device may perform the functions of multiple units or devices recited in the claims. Reference signs indicated in the patent claims are not to be regarded as limitations of the means and steps employed.

The invention claimed is:

1. An apparatus for low pressure die casting of metal, comprising:

at least one mold cavity defined by at least one at least partly surrounding cavity wall;

a system of sprues, runners and/or ingates defining at least one flow channel for filling the at least one mold cavity with molten metal;

at least one riser insert configured to be arranged at least partly inside at least one riser cavity of at least one riser, the at least one riser insert comprising at least one insert cavity for receiving the molten metal at least partly from the at least one mold cavity, and at least one insert cavity at least partly surrounded by a riser insert wall, the at least one riser insert being configured to at least partly decelerate solidification of the molten metal received by the at least one insert cavity; and at least one heating insert for at least partly heating the molten metal received by the at least one insert cavity, wherein the at least one heating insert is arranged at least partly inside the at least one riser cavity.

2. The apparatus of claim 1, wherein the at least one riser insert wall has a thickness of less than 5 cm.

3. The apparatus of claim 1, wherein the at least one riser insert wall has a thickness of less than 3 cm.

4. The apparatus of claim 1, wherein the at least one riser insert wall has a thickness of less than 1.5 cm.

5. The apparatus of claim 1, wherein the at least one riser comprises at least one insulator for insulating the molten metal received by the at least one insert cavity.

6. The apparatus of claim 5, wherein the at least one insulator comprises at least one air gap arranged between the riser insert wall and a riser wall of the at least one riser.

7. The apparatus of claim 5, wherein the at least one insulator comprises one or more materials selected from the group of: rock wool, stone wool, glass wool, and ceramic, and combinations thereof.

8. The apparatus of claim 1, wherein the at least one heating insert is arranged at least partly inside at least one protection element.

9. The apparatus of claim 1, wherein the at least one heating insert comprises one or more of: a burner, an electric heating cartridge, an inductive heating element, or combinations thereof.

10. The apparatus of claim 1, further comprising at least one holding element at least partly positioned between the at least one riser insert and the at least one heating insert, and at least partly positioned inside the riser cavity.

11. The apparatus of claim 1, wherein the at least one riser insert comprises one or more centering pins for aligning, fixating, or aligning and fixating the at least one riser insert inside the at least one riser cavity.

12. The apparatus of claim 1, wherein the at least one riser insert comprises at least one venting hole for ventilating the molten metal received by the at least one insert cavity.

13. The apparatus of claim 1, wherein the at least one riser insert is in fluid connection with at least one riser neck for receiving the molten metal at least partially from the at least one mold cavity.

14. A process for low pressure die casting of metal parts, the process comprising the steps of:

providing an apparatus comprising:

at least one mold cavity defined by at least one at least partly surrounding cavity wall;

a system of sprues, runners and/or ingates defining at least one flow channel for filling the at least one mold cavity with molten metal;

at least one riser insert configured to be arranged at least partly inside at least one riser cavity of at least one riser, the at least one riser insert comprising at least one insert cavity for receiving the molten metal at least partly from the at least one mold cavity, and at least one insert cavity at least partly surrounded by a riser insert wall, the at least one riser insert being configured to at least partially decelerate solidification of the molten metal received by the at least one insert cavity; and at least one heating insert for at least partly heating the molten metal received by the at least one insert cavity, wherein the at least one heating insert is arranged at least partly inside the at least one riser cavity;

filling the at least one mold cavity of the apparatus with the molten metal via the least one flow channel;

receiving the molten metal within the at least insert cavity at least partly from the at least one mold cavity; and at least partly decelerating the solidification of the molten metal received within the at least one insert cavity via operation of the at least one heating insert.

* * * * *